US010731865B2

(12) United States Patent
Jadhav et al.

(10) Patent No.: US 10,731,865 B2
(45) **Date of Patent: *Aug. 4, 2020**

(54) DOMESTIC APPLIANCE INCLUDING DOOR MOUNTED THROUGH ARTICULATED HINGE MECHANISM

(71) Applicant: Whirlpool Corporation, Benton Harbor, MI (US)

(72) Inventors: Tushar Jadhav, Pune (IN); Sachin Kadus, St. Joseph, MI (US); Sachin Karade, Pune (IN); Atul Nalawade, Pune (IN)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/241,093

(22) Filed: Jan. 7, 2019

(65) Prior Publication Data

US 2019/0137110 A1 May 9, 2019

Related U.S. Application Data

(63) Continuation of application No. 15/856,559, filed on Dec. 28, 2017, now Pat. No. 10,174,953, which is a (Continued)

(51) Int. Cl.

| | |
|---|---|
| ***F24C 15/02*** | (2006.01) |
| ***E05D 3/16*** | (2006.01) |
| ***E05D 3/18*** | (2006.01) |
| ***E05F 1/12*** | (2006.01) |
| ***E05F 5/06*** | (2006.01) |

(Continued)

(52) U.S. Cl.

CPC ..... *F24C 15/023* (2013.01); *A47L 15/4261* (2013.01); *E05D 3/14* (2013.01); *E05D 3/16* (2013.01); *E05D 3/18* (2013.01); *E05F 1/1261* (2013.01); *E05F 5/06* (2013.01); *E05F 5/08* (2013.01); *F24C 15/18* (2013.01); *E05D 2003/163* (2013.01); *E05Y 2900/30* (2013.01); *E05Y 2900/308* (2013.01)

(58) Field of Classification Search

CPC .... A47L 15/4261; F24C 15/18; F24C 15/023; E05D 3/14; E05D 3/16; E05D 3/18; E05F 1/1261; E05F 5/06; E05F 5/08

USPC ..... 312/311, 319.1, 319.2; 126/190, 192, 126/194; 16/287, 366

See application file for complete search history.

(56) References Cited

U.S. PATENT DOCUMENTS

| | | | |
|---|---|---|---|
| 438,435 | A | 10/1890 | Graves |
| 1,041,175 | A | 10/1912 | Scanlan |

(Continued)

FOREIGN PATENT DOCUMENTS

| | | |
|---|---|---|
| WO | 03/038219 | 5/2003 |

*Primary Examiner* — James O Hansen

(74) *Attorney, Agent, or Firm* — Diederiks & Whitelaw, PLC

(57) ABSTRACT

A domestic appliance, such as a double oven range, incorporates a door having a bottom end portion which, when shifted between closed and opened positions, both pivots and vertically shifts relative to a frame body of the appliance through at least a connecting rod, push rod and pivot arm of a hinge mechanism. Due to a combined pivoting and lifting action of the door, minimal to no clearance is required between the bottom end portion and adjacent structure.

23 Claims, 6 Drawing Sheets

Related U.S. Application Data continuation of application No. 15/642,449, filed on Jul. 6, 2017, now Pat. No. 9,874,354, which is a continuation of application No. 15/007,297, filed on Jan. 27, 2016, now Pat. No. 9,759,430.

(51) Int. Cl.

| | |
|---|---|
| ***A47L 15/42*** | (2006.01) |
| ***E05D 3/14*** | (2006.01) |
| ***E05F 5/08*** | (2006.01) |
| ***F24C 15/18*** | (2006.01) |

(56) References Cited

U.S. PATENT DOCUMENTS

| | | | | |
|---|---|---|---|---|
| 1,681,668 | A | 8/1928 | Jordan | |
| 1,864,164 | A | 6/1932 | Aldeen | |
| 2,135,280 | A | 11/1938 | Erickson | |
| 2,800,128 | A | 7/1957 | Chesser | |
| 3,116,903 | A | 1/1964 | Grantham | |
| 3,453,996 | A | 7/1969 | Agee | |
| 3,955,865 | A | 5/1976 | Wilson | |
| 4,163,344 | A | 8/1979 | Scherer | |
| 4,194,321 | A * | 3/1980 | Hess | E05F 1/10 126/194 |
| 7,275,283 | B2 | 10/2007 | Kistner et al. | |
| 7,934,290 | B2 | 5/2011 | Gherardi et al. | |
| 8,474,103 | B2 | 7/2013 | Lee | |
| 8,938,854 | B2 | 1/2015 | Lanzani | |
| 2007/0209654 | A1 | 9/2007 | Wang | |
| 2008/0276425 | A1 | 11/2008 | Gherardi et al. | |
| 2012/0060821 | A1 | 3/2012 | McNamee et al. | |
| 2015/0152675 | A1 | 6/2015 | Vanini | |

* cited by examiner

DOMESTIC APPLIANCE INCLUDING DOOR MOUNTED THROUGH ARTICULATED HINGE MECHANISM

CROSS-REFERENCE TO RELATED APPLICATION

This application is a continuation of U.S. application Ser. No. 15/856,559, filed on Dec. 28, 2017 and titled "Domestic Appliance Including Door Mounted Through Articulated Hinge Mechanism", pending, which is a continuation of U.S. application Ser. No. 15/642,449, filed on Jul. 6, 2017 and titled "Domestic Appliance Including Door Mounted Through Articulated Hinge Mechanism", now U.S. Pat. No. 9,874,354, which is a continuation of U.S. application Ser. No. 15/007,297, filed on Jan. 27, 2016 and titled "Domestic Appliance Including Door Mounted Through Articulated Hinge Mechanism", now U.S. Pat. No. 9,759,430. The entire content of these applications is incorporated herein by reference.

BACKGROUND OF THE INVENTION

The present invention pertains to the art of domestic appliances and, more specifically, a mechanism for mounting a door of a domestic or household appliance, such as the upper door of a dual oven cooking appliance, which causes the door to swing outward through a simultaneous lifting and pivoting action upon shifting the door from a closed position to an open position.

An oven door for a range or wall oven generally swings downward, about a fixed horizontal pivot axis, from a vertical closed position to a horizontal open position, to allow a customer access an associated cooking cavity. More specifically, to allow for the swinging movement, a bottom portion of the door is pivotally mounted to a pair of fixed, laterally spaced hinge brackets which project outward and establish an axis about which the door is supported for movement relative to the cavity. Typically, below the swinging door is arranged structure which must be cleared upon movement by the door. A sufficient clearance is therefore required below the door to accommodate the bottom part of the door when the door pivots.

The traditional solution is to provide a rather significant space or gap below the door for the required pivoting clearance. For example, in a typical dual cavity range or wall oven having a top cavity including a top door and a bottom cavity with a bottom door, a gap in the order of 16-18 mm is established between the bottom of the top door and a top portion of the bottom door to accommodate the pivoting of the respective doors. A similar gap must be provided below the bottom door. Given that an oven door includes multiple window panels, typically in the form of a window pack mounted between inner and outer door panels, the thickness of an oven door is generally quite thick, typically in the order of 3.5-5 cm. Although the gap below the bottom door may not present an aesthetic problem as it is generally hidden from view by the bottom door, the gap in between the top door and the bottom door (or other structure in a single cavity oven) features prominently and may detract a consumer from an otherwise elegant design of the appliance. That is, the consumer may get a perception of a poor appliance design, as opposed to the intended impression of a high-end, elegant and aesthetically pleasing design.

Based on the above, it is desirable to provide a mechanism for mounting a door of a domestic or household appliance, particularly the upper door of a dual oven range or wall, which will enable a gap below the door to be minimized, while still enabling the door to unobstructively shift between closed and open positions.

SUMMARY OF THE INVENTION

The present invention solves the aforementioned problems by providing a hinge mechanism for pivoting and lifting of a door, such as a top or upper door of a dual oven cooking appliance, either a range or wall oven. The hinge mechanism is pivotally connected to the door at two points of attachment: a first point of attachment near the bottom of the door and a second point of attachment which is spaced from the bottom of the door. The first point of attachment is used by the hinge mechanism to provide a lifting force to lift the door upon opening. To accommodate such lifting, the door pivots around the first point of attachment. As the door is being lifted, the door also pivots around the second point of attachment. Through the combination of the lifting and pivoting of the door as the door is shifted from a substantially vertical closed position to a substantially horizontal open position, the bottom part of the door requires only minimal clearance with the lower door or other directly adjacent lower structure. In other words, as the door is opened, the motion of the bottom of the door does not extend below the initial closed position. Therefore, the need for designing a gap below of the bottom of the door is essentially eliminated.

To accommodate the pivoting movement, particularly around the second point of attachment, the door structure is forced to move outward towards the user. To that end, the invention incorporates one or more of a slider mechanism or a cam mechanism. When the user provides an initial opening force, the slider or cam mechanism causes the desired outward movement of the first point attachment of the door. The mechanism also includes a balancing spring to provide counteracting forces to the weight of the door and a damping spring to retard movement of the door. The balancing and damping springs, in combination with the linkages of the hinge, establishes a sturdy overall structure which prevents the door from wobbling throughout its entire range of movement.

Additional objects, features, and advantages of the present invention will become more readily apparent from the following detailed description of preferred embodiments when taken in conjunction with the drawings wherein like reference numerals refer to corresponding parts in the several views.

DETAILED DESCRIPTION

Initially, it should be noted that the articulated hinge mechanism of the invention can be applied to a wide range of appliances having pivoting doors, specifically doors which pivot at a bottom portion thereof about a substantially horizontal axis, with the bottom portion being juxtapose lower structure which could potentially interfere with the desired pivoting movement such that a gap must be provided between the bottom portion of the door and the lower structure. In certain preferred embodiments, the articulated hinge mechanism of the invention may be incorporated into a cooking appliance, such as a cooking appliance including upper and lower oven cavities wherein a gap is provided between the bottom portion of the upper door and an uppermost portion of the lower door with the gap assuring that the lower door will not be abutted upon pivoting of the upper door between closed and opened positions. For exemplary purposes, the invention will now be described with reference to a dual oven range, however it should be understood that the invention is equally applicable to other types of cooking appliances, such as an oven range having a drawer below a single oven cavity or a dual oven cavity wall oven, as well as other types of appliances.

Figure 1:
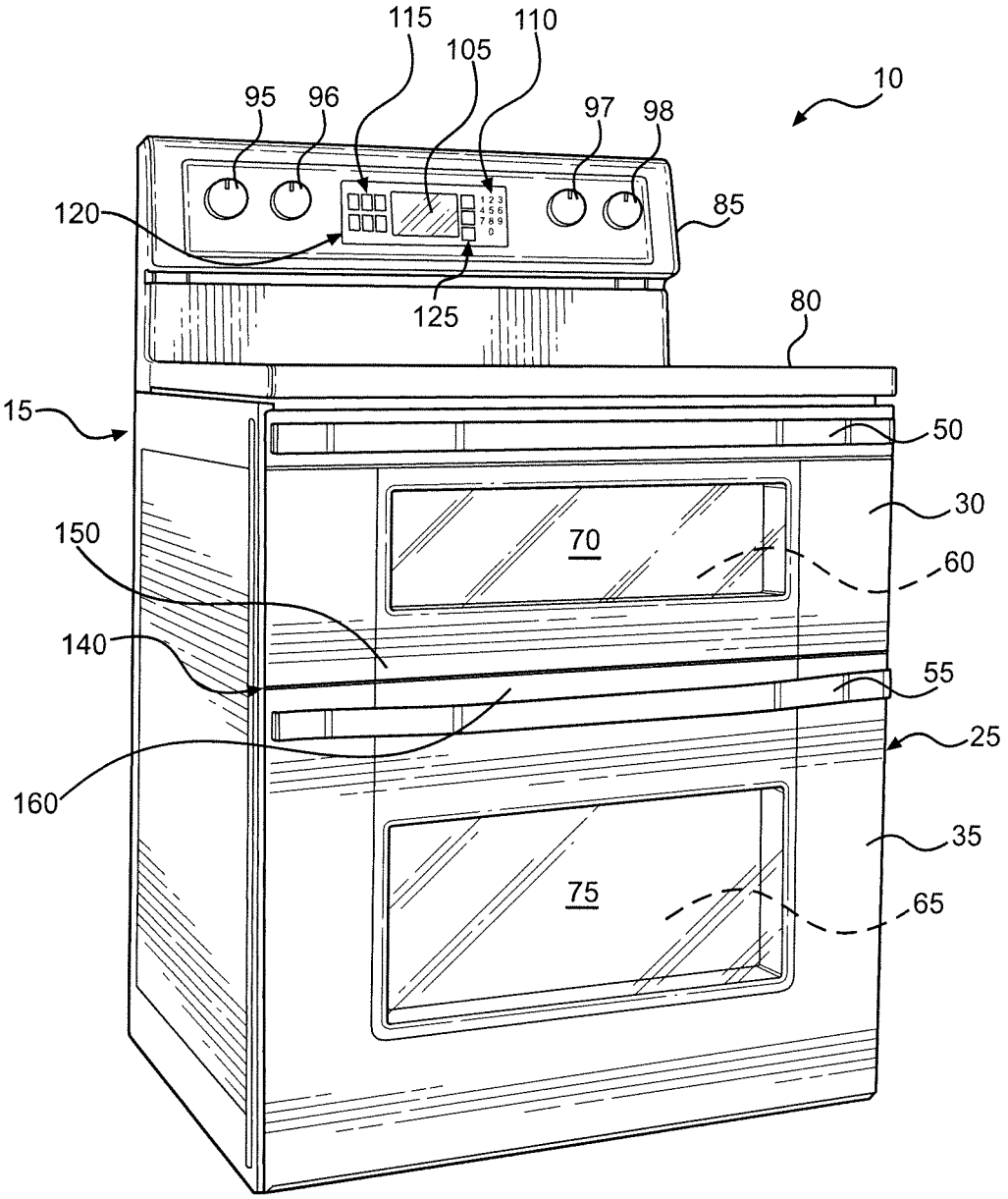
FIG. 1 is a perspective view of a dual oven range constructed in accordance with the present invention.

With initial reference to FIG. 1, a cooking appliance in the form of a slide-in, dual oven electric range is generally indicated at 10. In the embodiment shown, range 10 includes a cabinet 15 within which is arranged a first or upper oven 20 and a second or lower oven 25. Upper and lower ovens 20 and 25 have associated doors 30 and 35 which include respective handles 50 and 55 that can be used to pivot doors 30 and 35 between substantially vertical or upright closed positions and substantially horizontal open positions in order to access respective cooking chambers or cavities 60 and 65. As depicted, doors 30 and 35 also include respective viewing windows 70 and 75, which can be in the form of insulated window packs.

Cabinet 15 is also provided with an associated range top 80 having various spaced surface heating regions (not shown) in a manner known in the art. At an upper rear portion, cabinet 15 includes an upstanding portion 85 which is provided with a control panel 90. As depicted, upstanding portion 85 is shown to include a plurality of knobs 95-98 for use in selectively activating and deactivating the various surface heating regions. Between knobs 95-98 is a display 105, such as an LED, LCD or VFD display. Furthermore, control panel 90 is provided with a number pad 110 and various other sets of buttons, such as indicated at 115, 120 and 125, for setting display, timing, cooking and the like functions.

In general, the structure set forth above has been provided for the sake of completeness and is widely known in the art. Certainly, while knobs, buttons and the like have been referenced, a wide range of control elements could be employed. Instead, the present invention is directed to an articulated hinge mechanism provided to enable an associated door, such as oven door 30, to move with obstruction between the desired closed and opened positions with only a minimal gap, indicated at 140, between a lower or bottom portion 150 of door 30 and an upper or top portion 160 of door 35. Although reference will be made to the structure and operation of the articulated hinge mechanism for use with door 30, it should be understood that a corresponding hinge mechanism could be employed to enable door 35 to pivot between closed and opened positions with a minimal gap to a range supporting or ground surface (not labeled), a wall oven door to correspondingly pivot with a minimal gap to a juxtapose door or cabinet structure, or a door of another appliance to pivot between corresponding positions relative to directly adjacent structure which would, with a similar minimal gap and without the articulated hinge mechanism of the invention, not exhibit the requisite clearance and therefore would obstruct the desired relative movement.

With reference to FIGS. 2-5, a first embodiment of the invention is depicted with reference to an articulating hinge mechanism 200 supporting one lateral side of door 30 for movement relative to cabinet 15. At this point, it should be understood that a corresponding hinge mechanism 200 would be employed on the other lateral side of door 30. As shown, hinge mechanism 200 includes a pivot arm 210, a push rod 215, a slider mechanism 220, a connecting rod 225, and other components as described below. Pivot arm 210 constitutes a dyad that includes two elements 210*a* and 210*b* connected at an angle to each other. Pivot arm 210 is supported by cabinet 15 through a pin joint 211. Pin joint 211 allows pivot arm 210 to pivot along an axis orthogonal to the plane of a corresponding sidewall (not separately labeled) of cabinet or frame body 15. At one end of pivot arm 210, element 210*b* is connected with door 30 by a pivot joint 205*a*. A stud 241 abuts element 210*b* and restricts the downward pivoting of pivot arm 210 when door 201 is in a closed position. At the other end of pivot arm 210, element 210*a* is connected with push rod 215 by a pivot joint 212, while push rod 215 is connected with slider mechanism 220 through a pivoting joint in the form of a pivot pin 221. Connecting rod 225 is also connected with slider mechanism 220 through pivot pin 221. In some embodiments, each of connecting rod 225 and push rod 215 can be connected with slider mechanism 220 by two different pivot joints. In any case, connecting rod 225 is attached to door 30 through a pivot joint 205*b*. A balancing spring mechanism 230 is connected with slider mechanism 220 to provide a counter force against the weight of door 30.

Slider mechanism 220 also includes a slot or channel 234 into which pivot pin 221 projects such that slot 234 guides the movement of pivot pin 221 relative to cabinet 15. In this embodiment, this guided movement is substantially linear and fore-to-aft relative to cabinet 15, although non-linear movement could be employed. Therefore slot 234 may be linear or non-linear, curved or include a combination of curves, to facilitate the complex motion of door 30. In some embodiments, various friction reducing structures, such as cams, wheels or bushings, are used to facilitate the motion of the pivot pin 221 along slot 234.

Figure 3:
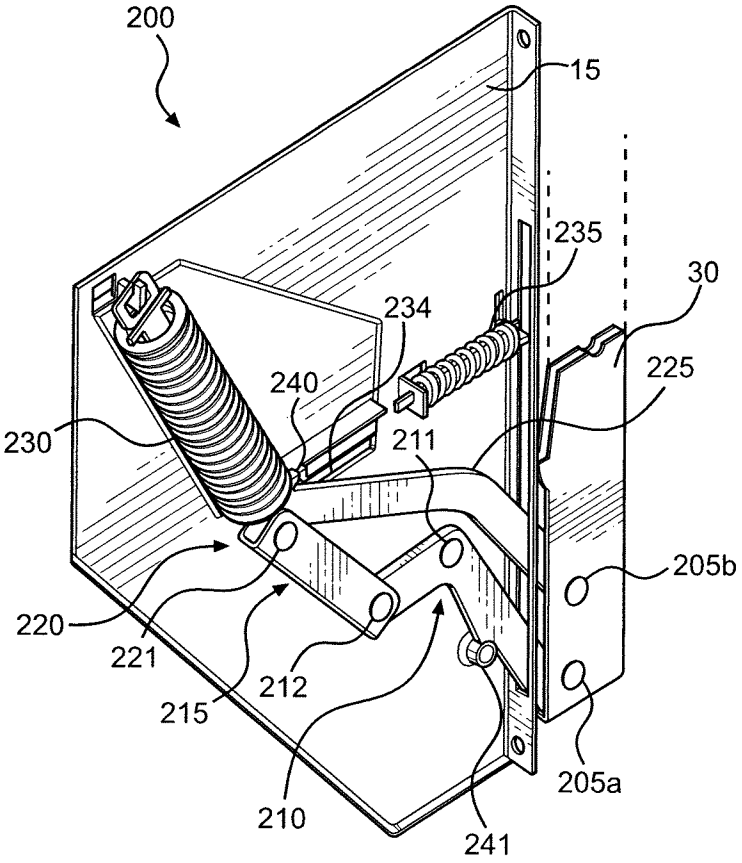
FIG. 3 is a perspective view of the hinge mechanism of FIG. 2.
Figure 2:
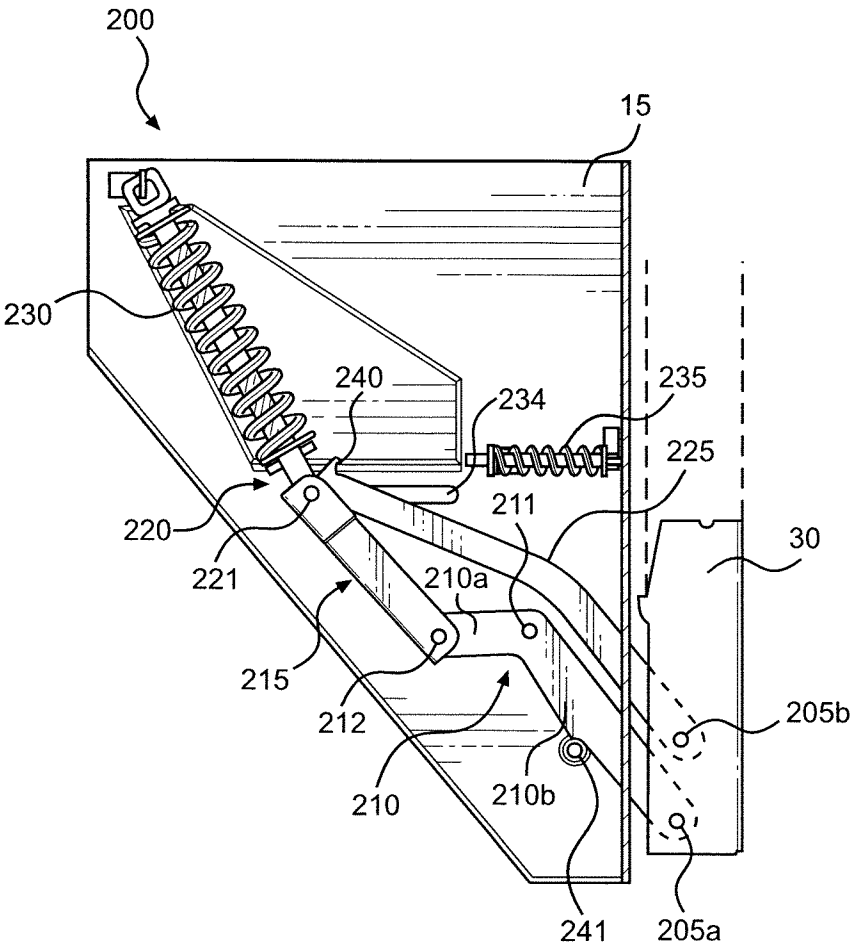
FIG. 2 is a side view of a hinge mechanism incorporated into the oven range of FIG. 1 according to a first embodiment of the invention.
Figure 4:
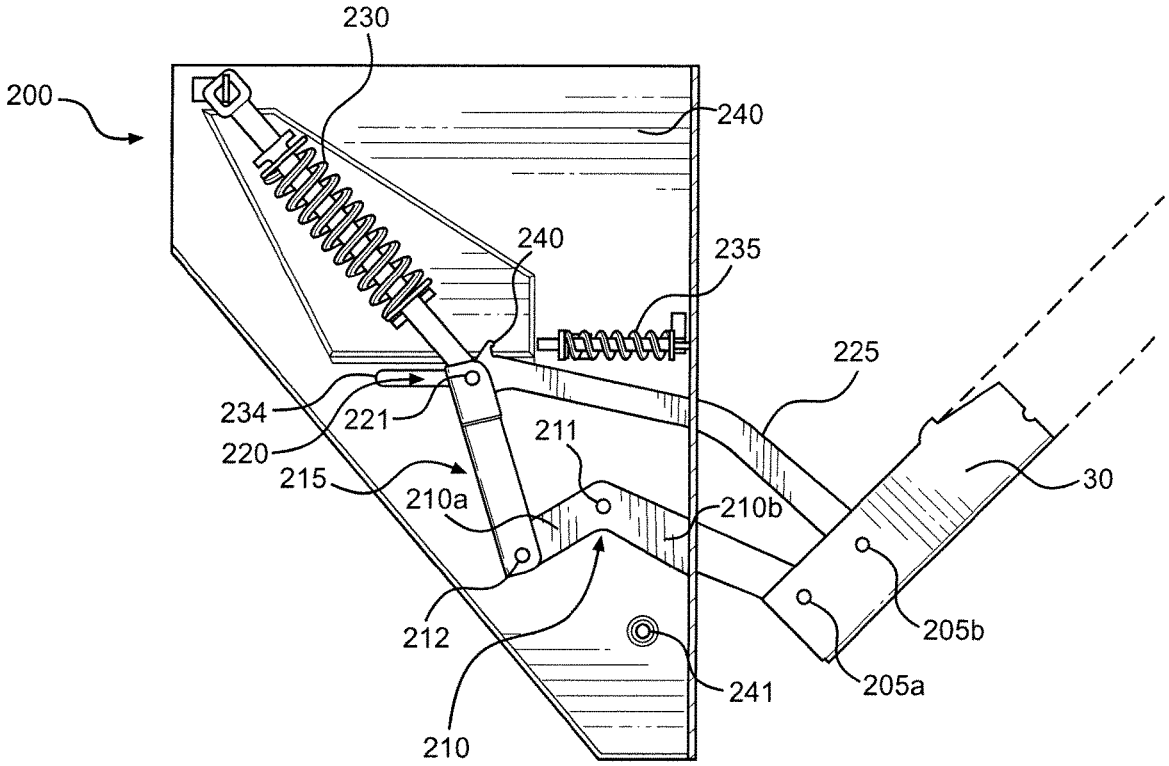
FIG. 4 is a side view of the hinge mechanism of FIGS. 2 and 3, with the oven door in an intermediate or partially open position.
Figure 5:
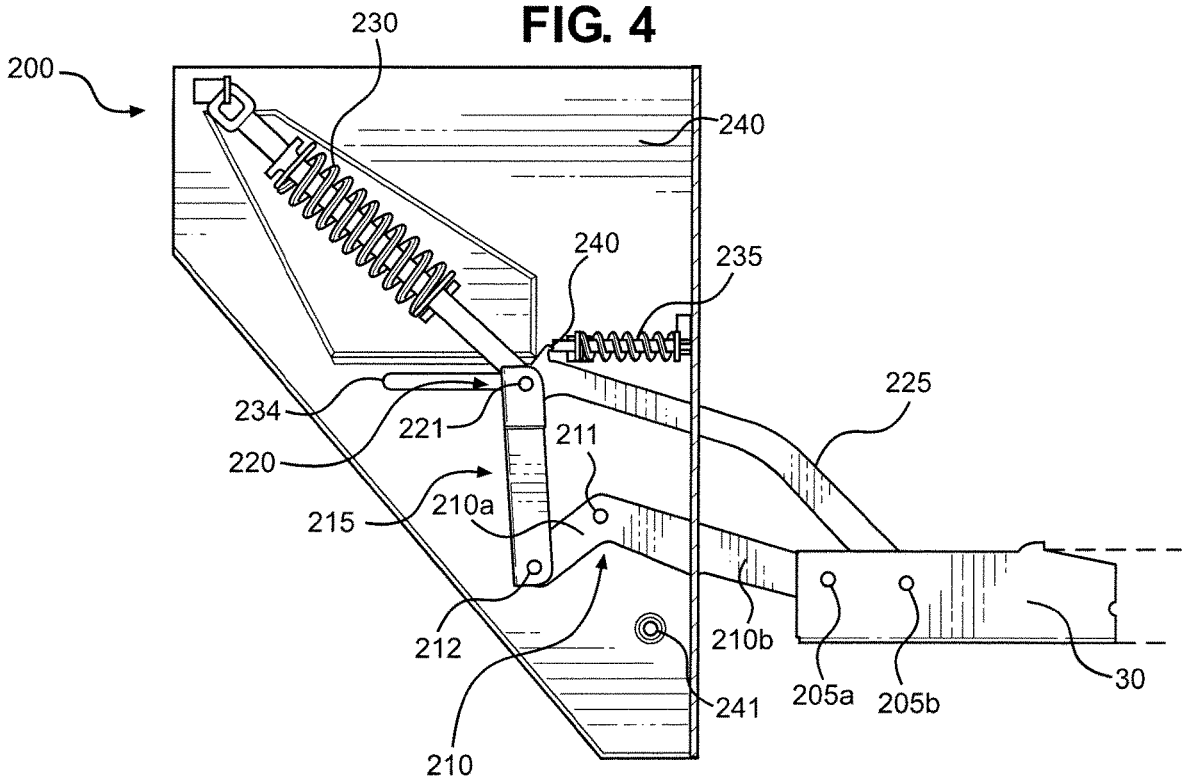
FIG. 5 is a side view of the hinge mechanism of FIGS. 2 and 3, with the oven door in a fully open position.
Figure 6:
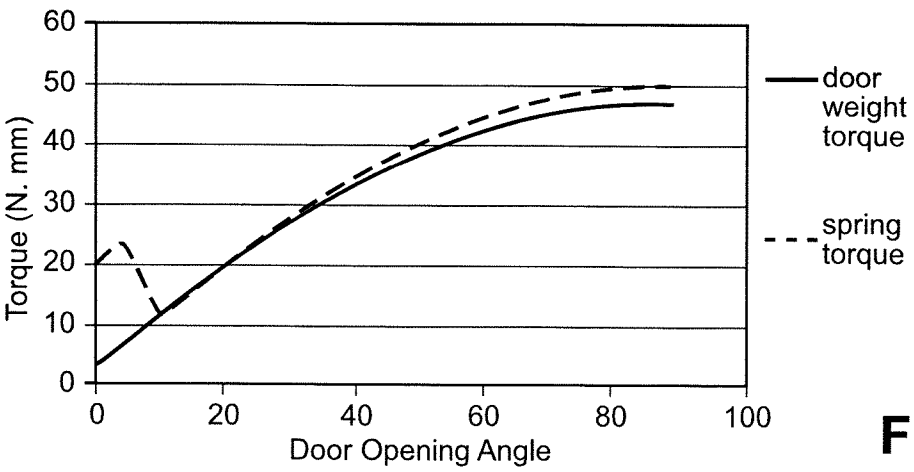
FIG. 6 is a chart showing relative door weight torque and spring torque values throughout movement of the oven door from a closed position to the fully open position.

The opening of range door 30 using hinge mechanism 200 will now be described with particular reference to FIG. 2-5, with FIGS. 2 and 3 showing door 30 in a substantially vertical or upright closed position, FIG. 5 showing door 30 in a substantially horizontal or opened position, and FIG. 4 presenting an intermediate position. Initially, starting from the closed position of FIG. 3, a user wishing to open door 30 would apply an initial opening force by pulling on door handle 50 (FIG. 1). By the impact of the initial opening force, a pivoting of door 30 is induced around pivoting joint 205*a*. The pivoting action causes door 30 to pull connecting rod 225 forward towards the user. Connecting rod 225, in turn, pulls slider mechanism 220 forward relative to cabinet 15. As slider mechanism 220 starts sliding towards the closed position of door 30 with pivot pin 221 being guided in slot 234, balancing spring mechanism 230 and push rod 215 come into action. More specifically, push rod 215 pushes element 210*a* of pivot arm 210 downward. The downward motion of element 210*a* causes pivot arm 210 to pivot around pivot pin 211 which, in turn, causes element 210*b* to move upward. Element 210*b*, as it moves upward, lifts the bottom portion 150 of door 30, as particularly evident upon comparing FIGS. 2 and 5. As door 30 further opens, door 30 continues to pivot around one or both of pivoting joints 205*a* and 205*b* until it reaches a horizontal position as shown in FIG. 5. The force applied by pivot arm 210 is orthogonal to the pivot axis of door 30 at the pivoting joint 205*b*. During this movement, balancing spring mechanism 230 becomes compressed and force or torque created based thereon pulls back slider mechanism 220 to provide balancing force or torque, which tracks the opposing weight of door 30 as door 30 pivots, lifts and approaches the horizontal position as shown in FIG. 6. As door 30 assumes the horizontal position, a damping spring 235 is abutted by an actuator 240 extending from connecting rod 225 and retards the movement of slider mechanism 220.

Figure 7:
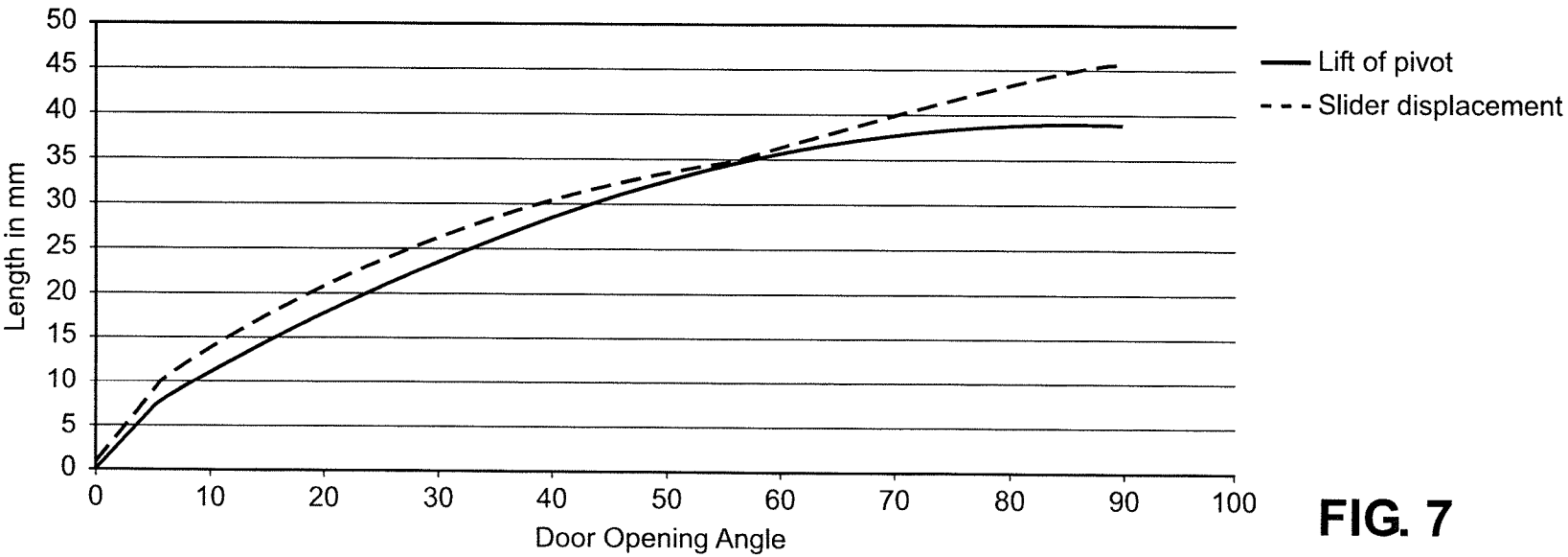
FIG. 7 is a chart showing door lifting and sliding displacements throughout movement of the oven door from the closed position to the fully open position.

Based on the above, it should be readily apparent that bottom portion 150 of door 30 does not shift downward relative to cabinet 15 below an initial, closed position, but instead is actually lifted up as door 30 is displaced from the closed position of FIGS. 2 and 3. This relationship of lifting and shifting of door 30 throughout its range of motion is shown in FIG. 7. For this reason, essentially no gap 140 is therefore required between bottom portion 150 of door 30 and upper portion 160 of door 35 for the opening of door 30. Even if door 35 retains a known, fixed horizontal pivot axis in connection with its opening/closing motion, gap 140 can still be, for all intensive purposes, minimized, i.e., 10 mm or less and most preferably 5 mm or less, in comparison to prior arrangements which typically require gaps in the order of 16-18 mm. In addition, the six link with slider and dyad arrangement of the present invention requires a low, initial opening force, generally in the order of 40 N. By employing pin joints and a slider, potential wear is reduced. Overall, the hinge mechanism is considered to be parts efficient, operationally effective, and aesthetically beneficial.

Another exemplary embodiment of the invention is shown in FIGS. 8-11 with reference to a hinge mechanism 300. As depicted, hinge mechanism 300 includes a cam dyad 310, a pivot arm 320, a push rod 330, a connecting rod 335, a cam follower 312, a balancing spring mechanism 325, and other elements described herein. Pivot arm 320 includes elements 320*a* and 320*b* connected at an angle to each other. Pivot arm 320 is fitted on a cabinet or frame body 340 using a pin joint 321, wherein pin joint 321 allows pivot arm 320 to pivot around an axis orthogonal to a planar sidewall portion of frame body 340. Element 320*a* of pivot arm 320 is connected with a door holder 302 by a pivot joint 305*a*. Door holder 302 supports door 30 in a manner known in the art such that, for purposes of this discussion, the laterally spaced door holders 302 are simply considered part of door 30. A stud 341 abuts and restricts the downward pivoting of element 320*a* when door 30 is in a closed position. At the other end of pivot arm 320, element 320*a* is connected with push rod 330 through pivot joint 331. Push rod 330 is, in turn, connected to cam dyad 310 through a pivot joint 332, while cam dyad 310 is connected with connecting rod 332 through a pivot joint 336. Connecting rod 335 is connected with door 30 through pivot joint 305*b*. In any case, cam dyad 310 includes a cam surface 311 that interacts with cam follower 312. A spring 313 provides a dampening force against the movement of cam follower 312. Cam dyad 310 is rotatably connected with frame body 340 using a pin joint 314. Balancing spring mechanism 325 provides a force against the rotation of cam dyad 310 in a clockwise direction, i.e. towards door 30.

Figure 9:
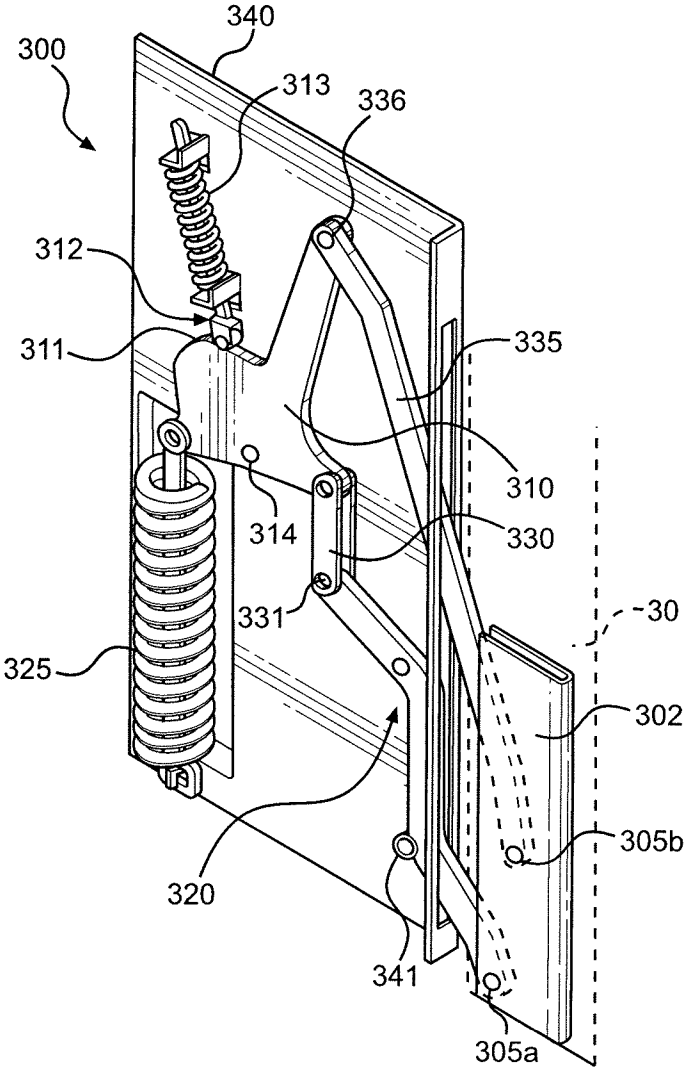
FIG. 9 is a perspective view of the hinge mechanism according to the second embodiment of the invention, with the oven door in a closed position.
Figure 8:
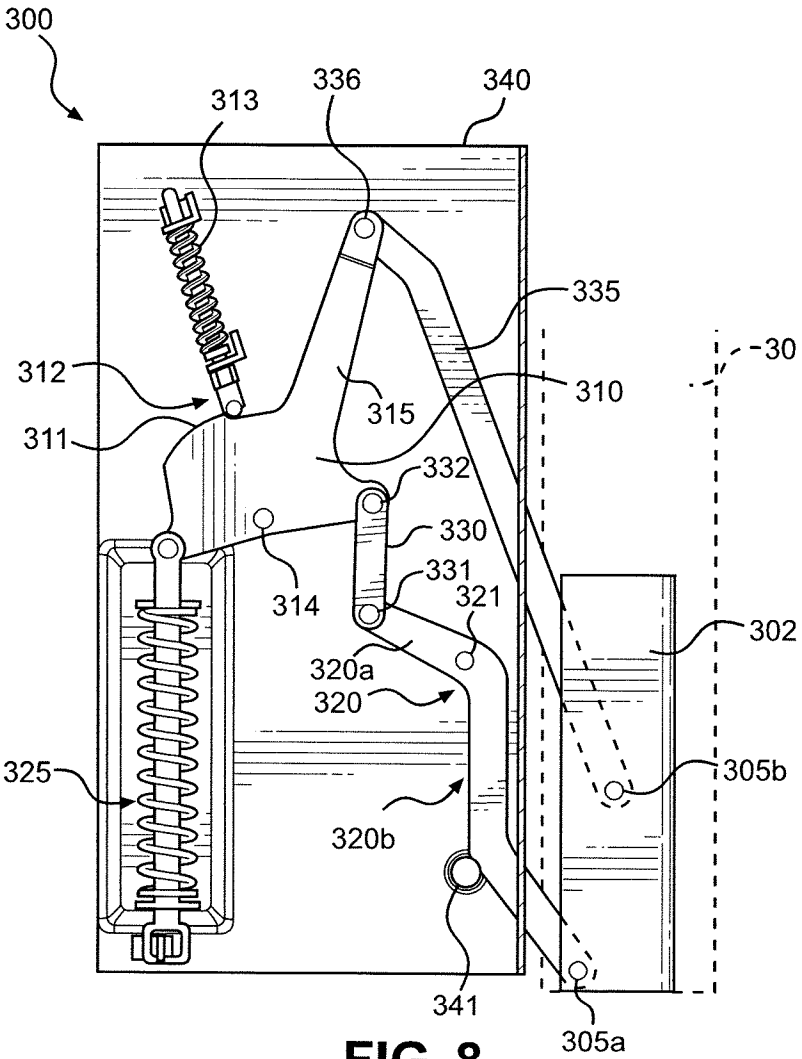
FIG. 8 presents a side view of a hinge mechanism constructed in accordance with a second embodiment of the invention, when the oven door is in a closed position.
Figure 10:
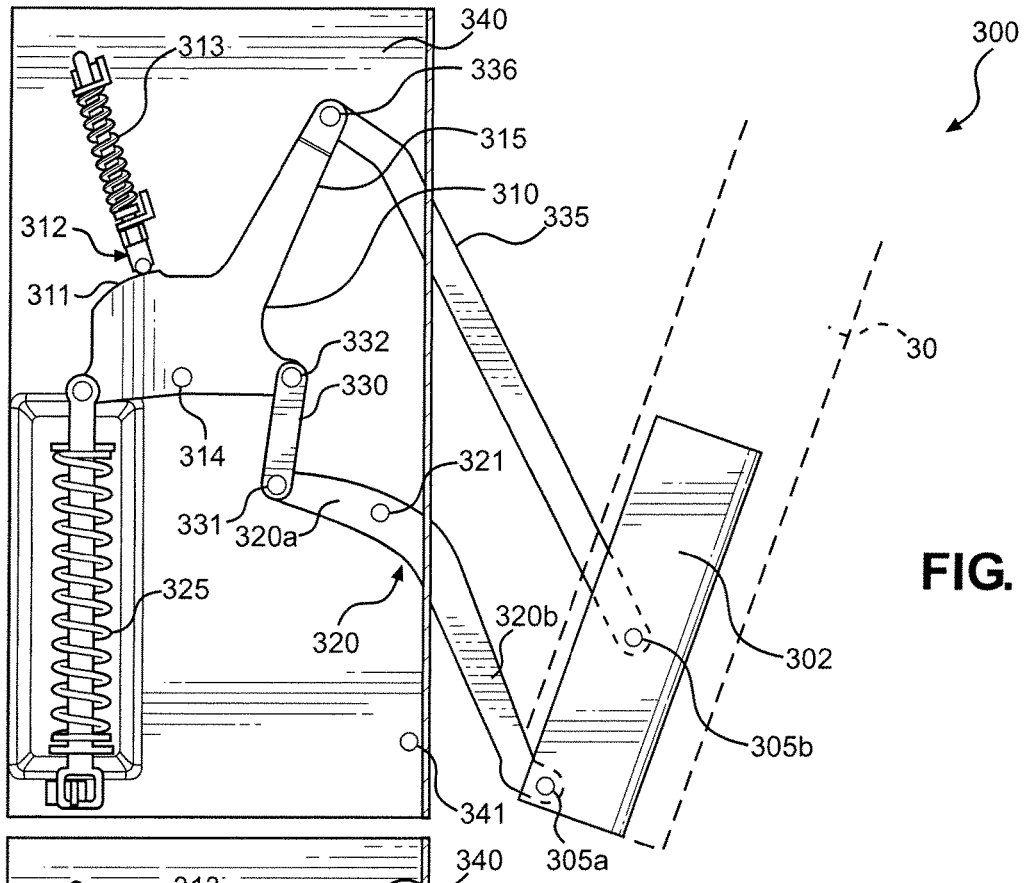
FIG. 10 is a side view of the hinge mechanism of FIGS. 8 and 9, with the oven door being in an intermediate or partially open position.
Figure 11:
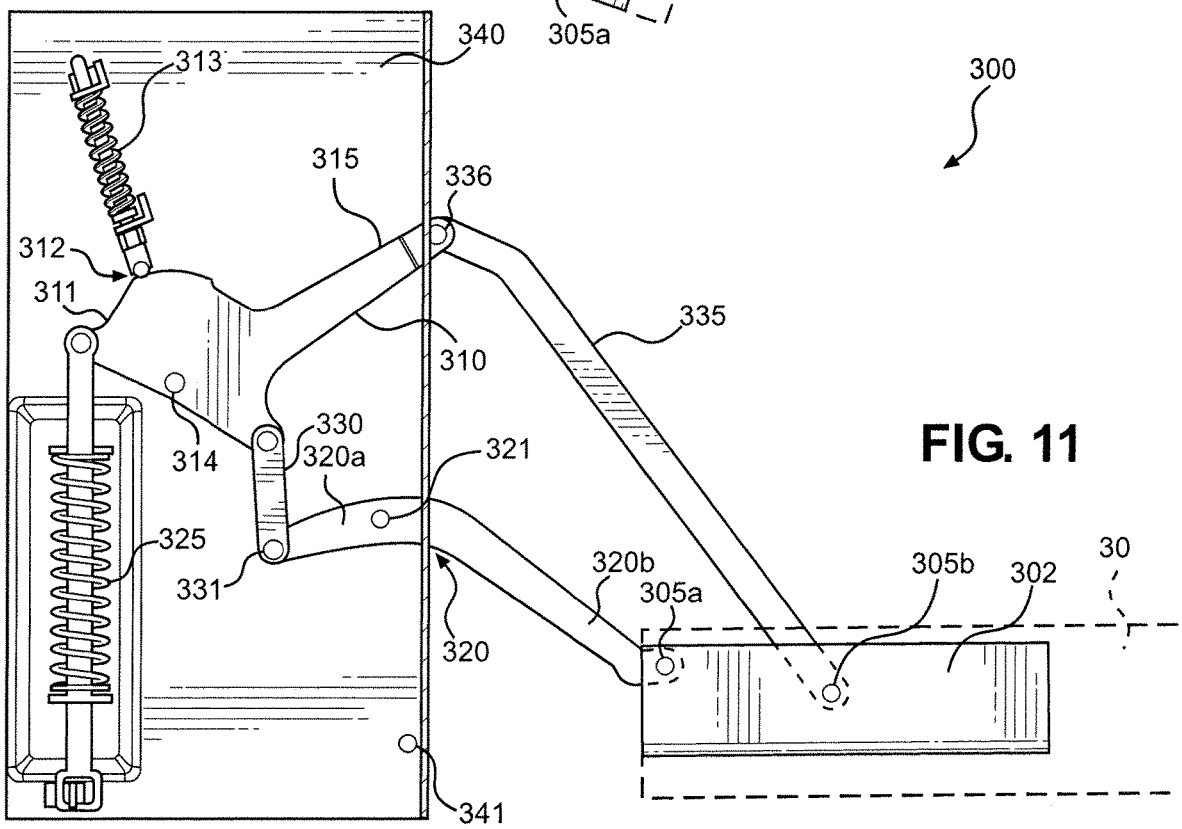
FIG. 11 is a side view of the hinge mechanism according to the second embodiment, with the oven door in a fully opened position.

The operation of hinge mechanism 300 will now be described, particularly with reference to FIGS. 8 and 9 showing hinge mechanism 300 when door 30 is in a closed position, FIG. 11 showing door 30 in a fully opened position, and FIG. 10 illustrating door 30 in an intermediate position. As with the earlier described embodiment, to open door 30 a user applies an initial opening force on door handle 50, with the initial opening force being sufficient to overcome at least the resistance provided by the interaction of cam surface 311 with cam follower 312. The initial opening force causes door 30 to pivot around each of pivoting joints 305*a* and 305*b*, while the pivoting motion causes door 30 to pull connecting rod 335 outward. In turn, connecting rod 335 pulls upper body 315 of cam dyad 310 forward to cause cam dyad 310 to rotate in a clockwise direction about pin joint 314 forward towards door 30. As cam dyad 310 rotates, cam surface 311, balancing spring mechanism 325 and push rod 330 come into action. More specifically, push rod 330 pushes element 320*a* of pivot arm downward. The downward push on element 320*a* causes pivoting arm 320 to pivot around pin joint 321 and the pivoting motion of pivot arm 320 causes element 320*b* to move upward. Element 320*b*, as it moves upward, lifts door 30. The lifting force applied by element 320*b* is orthogonal to the pivot axis of door 30 at pivoting joint 305*b*. As cam dyad 310 rotates, balancing spring mechanism 325 is compressed, thereby pulling back cam dyad 310 to provide a balancing force against the weight of door 30. In addition, cam follower 312 tracks cam surface 311 to retard door movement.

Based on the above, it should be apparent that the connecting rod acts through the cam dyad in this second embodiment to control the push rod in a manner similar to the connecting rod and slider mechanism of the first embodiment. As indicated above, the balancing spring mechanism in both preferred embodiments provides a force to counteract the weight of the door. The interaction between the balancing spring mechanism and other elements of the hinge mechanism ensures that there is no wobbliness as the door is being opened and closed. Similarly, the door is very stable when the door is in the horizontal open position. In general, the hinge mechanism provides for a strong and well-built feeling for the door. Various materials can be used for constructing the hinge mechanism, including plastics, metals, alloys, etc. Although the slider and cam mechanisms are provided separately in the embodiments described, a combination of these mechanisms can be included in some embodiments. As indicated above, the invention can be used in connection with various door mountings, particularly when there is minimal space for maneuvering the door. In addition, although reference has been made to a supporting cabinet in connection with the exemplary embodiments discussed, it should be understood that the appliance can have a cabinet, shell or, generically, any form of frame body, for attachment of the various hinge mechanism components utilized in supporting movement of the door. Furthermore, the type of cavity associated with the door will obviously vary depending on the specific appliance to which the invention is applied, such as, for example, from the oven cavity referenced above to a dishwasher cavity. In any case, although described with reference to preferred embodiments, various changes and/or modifications can be made to the invention without departing from the spirit thereof.

The invention claimed is:

1. A domestic appliance comprising:

a frame body;

a cavity provided in the frame body;

a door mounted for movement relative to the cavity between a closed position, where the door closes off the cavity, and an opened position, where access to the cavity is provided, the door having a front face, a rear face and a bottom end extending between the front face and the rear face; and a hinge mechanism for supporting the door for movement between the closed and opened positions, the hinge mechanism including a pivot arm having a first, end portion pivotally attached to the door at a first point of attachment and a second portion pivotally attached to the frame body, wherein, upon movement of the door from the closed position to the opened position, the door is configured to pivot downward around the first point of attachment, and the pivot arm is configured to pivot about the second portion and lift the door relative to the cavity such that an entirety of the bottom end of the door is located vertically higher in the opened position than in the closed position.

2. The domestic appliance of claim 1, wherein:

the hinge mechanism further includes a connecting rod having one end portion pivotably attached to the door at a second point of attachment; and upon movement of the door from the closed position to the opened position, the door is configured to pivot around the second point of attachment.

3. The domestic appliance of claim 2, wherein, upon movement of the door from the closed position to the opened position, the connecting rod is configured to cause the pivot arm to pivot about the second portion and lift the door relative to the cavity.

4. The domestic appliance of claim 2, wherein the connecting rod has another end portion mounted for pivotal movement relative to the frame body.

5. The domestic appliance of claim 1, wherein:

the second portion of the pivot arm is an intermediate portion;

the pivot arm has a third, end portion;

the hinge mechanism further includes a push rod connected to the third, end portion; and upon movement of the door from the closed position to the opened position, the push rod is configured to cause the pivot arm to pivot about the second, intermediate portion and lift the door relative to the cavity.

6. The domestic appliance of claim 1, wherein the hinge mechanism further includes:

a connecting rod;

a push rod; and a slider mechanism guiding movement of each of the connecting rod and the push rod, wherein the slider mechanism includes a pivot pin joining the connecting rod and the push rod, with the pivot pin extending into and slidably mounted relative to a slot.

7. The domestic appliance of claim 6, wherein the pivot pin directly connects the push rod to the connecting rod.

8. The domestic appliance of claim 1, further comprising a damping spring configured to dampen movement of the hinge mechanism as the door approaches the opened position.

9. The domestic appliance of claim 8, wherein:

the hinge mechanism further includes a connecting rod and a push rod; and the damping spring is configured to dampen movement of at least one of the pivot arm, connecting rod and push rod as the door approaches the opened position.

10. The domestic appliance of claim 9, further comprising an actuator provided on the connecting rod, the actuator being configured to shift the damping spring as the door approaches the opened position.

11. The domestic appliance of claim 1, wherein:

the hinge mechanism further includes a cam dyad mounted for pivotal movement, a connecting rod and a push rod; and each of the connecting rod and push rod are pivotally attached to the cam dyad.

12. The domestic appliance of claim 1, wherein the hinge mechanism further includes a cam dyad mounted for pivotal movement, the domestic appliance further comprising a damping spring including a cam follower, wherein the cam dyad defines a cam surface engaged by the cam follower, with the damping spring biasing the cam follower into engagement with the cam surface and dampening pivotal movement of the cam dyad.

13. The domestic appliance of claim 1, wherein the cavity is an upper oven cavity, and the door provides access to the upper oven cavity, the domestic appliance further comprising a lower oven cavity, wherein, when the door is in the closed position, the bottom end of the door is spaced less than 5 mm from a top end portion of a door of the lower oven cavity.

14. The domestic appliance of claim 1, wherein the pivot arm is bent at the second portion.

15. The domestic appliance of claim 1, wherein:

the hinge mechanism further includes a balancing spring providing a counter force against a weight of the door upon opening of the door; and the balancing spring is mounted for pivotal movement.

16. The domestic appliance of claim 15, wherein:

the hinge mechanism further includes a connecting rod and a push rod; and the balancing spring is mounted for pivotal movement relative to each of the pivot arm, connecting rod and push rod.

17. The domestic appliance of claim 1, wherein the second portion of the pivot arm is pivotally attached to the frame body at a location of the second portion.

18. The domestic appliance of claim 1, wherein the second portion of the pivot arm is an intermediate portion, and the pivot arm has a third, end portion.

19. The domestic appliance of claim 1, wherein the first, end portion of the pivot arm is pivotally attached to a bottom end portion of the door, and the hinge mechanism further includes a connecting rod having one end portion pivotably attached to the bottom end portion of the door.

20. A method of shifting a door mounted for movement between a closed position, where the door closes off a cavity provided in a frame body of a domestic appliance, and an opened position, where access to the cavity is provided, the door having a front face, a rear face and a bottom end extending between the front face and the rear face and being supported by a hinge mechanism for movement between the closed and open positions, the hinge mechanism including a pivot arm having a first, end portion pivotally attached to the door at a first point of attachment, the method comprising:

initiating opening of the door to cause the door to pivot downward relative to the cavity about a first pivot axis defined at the first point of attachment between the door and the first, end portion of the pivot arm; and causing the pivot arm to pivot relative to the cavity about a second portion of the pivot arm pivotally attached to the frame body and lift the door relative to the cavity through the first point of attachment such that an entirety of the bottom end of the door is located vertically higher in the opened position than in the closed position.

21. The method of claim 20, wherein causing the pivot arm to pivot relative to the cavity about the second portion includes causing a connecting rod, having one end portion pivotably attached to the door at a second point of attachment, to apply a force to the pivot arm.

22. The method of claim 20, further comprising at least one of:

guiding movement of each of a connecting rod and a push rod with a slider mechanism;

dampening movement of at least one of the pivot arm, connecting rod and push rod as the door approaches the opened position; and providing a counter force, with a balancing spring, against a weight of the door upon opening the door.

23. A method of shifting a door between a closed position, where the door closes off a cavity of a domestic appliance, and an opened position, where access to the cavity is provided, the door having a front face, a rear face and a bottom end extending between the front face and the rear face, the method comprising:

initiating opening of the door to cause the door to pivot downward about a first pivot axis defined at a first point of attachment between the door and a first, end portion of a pivot arm; and causing the pivot arm to pivot relative to the cavity about a second portion of the pivot arm and lift the door through the first point of attachment such that an entirety of the bottom end of the door is located vertically higher in the opened position than in the closed position, wherein:

causing the pivot arm to pivot relative to the cavity about the second portion includes causing a push rod, connected to a third, end portion of the pivot arm, to apply a force to the pivot arm; and the second portion of the pivot arm is an intermediate portion.

* * * * *